United States Patent [19]

Wexler

[11] 4,314,422

[45] Feb. 9, 1982

[54] ROLLING TOY

[76] Inventor: Howard Wexler, 300 E. 40th St., New York, N.Y. 10016

[21] Appl. No.: 201,433

[22] Filed: Oct. 28, 1980

[51] Int. Cl.[3] ..... A63H 15/08

[52] U.S. Cl. ..... 46/134; 46/1 R

[58] Field of Search ..... 46/1 R, 134, 42, 43; 273/128 A, 128 R, 120 R, 108, 126 R, 109, 110, 112, 113, 115, 116, 117, 341

[56] References Cited

U.S. PATENT DOCUMENTS

| | | | |
|---|---|---|---|
| 1,254,428 | 1/1918 | Myers | 46/134 |
| 1,282,724 | 10/1918 | Anderson | 46/134 X |
| 3,073,598 | 1/1963 | Tiikkainen | 46/134 X |
| 3,400,932 | 9/1968 | Conrad | 273/128 A X |
| 4,238,904 | 12/1980 | Lang | 46/134 X |

*Primary Examiner*—Robert Peshock
*Assistant Examiner*—Mickey Yu
*Attorney, Agent, or Firm*—Davis, Hoxie, Faithfull & Hapgood

[57] ABSTRACT

A rolling toy that comprises a spherical weight within a container. A representation of a face is on the container's surface. The container is contoured such that it can roll or tumble. The container is so proportioned to produce a variety of random rolling or tumbling modes that are psychologically unanticipated by the user.

13 Claims, 6 Drawing Figures

ROLLING TOY

BACKGROUND OF THE INVENTION

1. Field of the Invention

The present invention is a rolling toy containing on its surface a representation of a face.

2. Description of the Prior Art

Prior rolling toys produce psychologically unanticipated rolling to only a limited degree.

For example, one prior art toy discloses a spherical container enclosing a spherical weight. Rolling is not psychologically unanticipated, although the direction of rolling may change somewhat due to the interaction of the inner and outer spheres.

Another prior art toy, often referred to as a jumping bean, comprises a cylindrical container with hemispherical ends enclosing a spherical weight. The sphere's translational motion is limited to one degree of freedom—the longitudinal direction. Tumbling is in this direction only.

SUMMARY OF THE INVENTION

The present invention comprises a spherical weight within a container contoured so that it can randomly roll or tumble; the container is of neither spherical nor cylindrical shape. The container has a representation of a face applied to its outer surface. The container shape significantly departs from a spherical shape such that motion of the sphere within the container produces a variety of rolling and tumbling modes that are psychologically unanticipated by the user.

The invention's ability to roll and tumble in a variety of ways despite its flattened appearance provides more entertainment than prior art toys.

DESCRIPTION OF THE PREFERRED EMBODIMENTS

Figure 1:
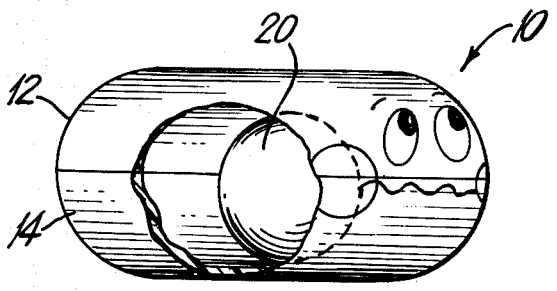
FIG. 1 shows one embodiment of the invention, with a portion of the container cut away to show the spherical weight contained within.

FIG. 1 shows a container 10 in the shape of an oblate spheroid. For illustrative purposes, a portion of the container is cut away in FIG. 1 to reveal a spherical weight 20 within the container 10.

Figure 2A:
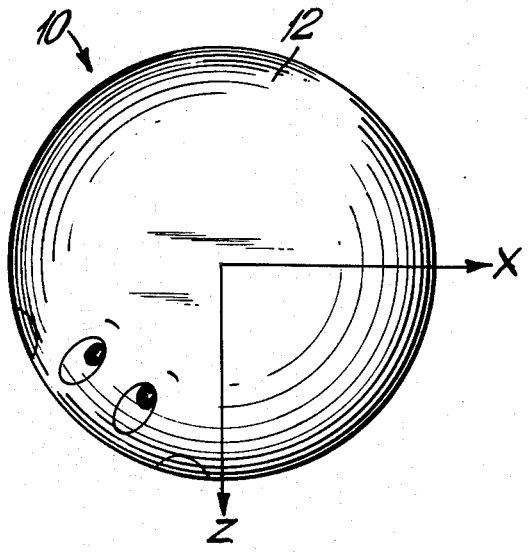
FIGS. 2A and 2B shows top and side orthographic views of one embodiment of the present invention.
Figure 2B:
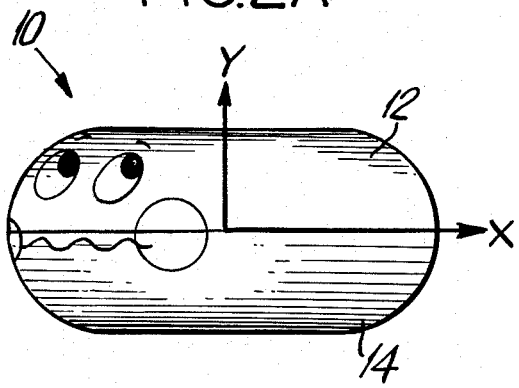

FIG. 2 depicts top and side orthographic views of the container 10. A rectilinear coordinate axes system is superimposed on the views, with the letters "X", "Y" and "Z" used to designate each of the three coordinate axes. While the container 10 in FIGS. 1 and 2 is in the shape of an oblate spheroid, it can be of any shape subject to the following limitations:

1. the container should preferably be radially symmetrical about one longitudinal axis, which is shown in FIG. 2B as coincident with the "Y" coordinate axis; and 2. the surface of the container must be sufficiently curved and sufficiently free of depressions, projections or sharp corners to allow the container to pitch or tumble in any direction; and 3. the largest diameter of the container 10 must be about 1.8 to 1.9 times as large as the distance between the top and bottom surface of the container measured along the longitudinal axis.

While the container 10 can be of any shape subject to the limitations just described, it preferably has a surface shape defined by the revolution of a curved line about the longitudinal axis, the longitudinal axis in such a case being an axis of revolution. In one embodiment of the present invention, the curved line is an ellipse.

The container may be constructed of two similarly shaped surfaces 12 and 14 fastened together at their peripheries. Fastening may be accomplished, for example, by gluing or press-fitting the two surfaces. A representation of a face may be applied around the perimeter area of the container, as is shown in the figures.

To use the invention, the user can prod the container 10 with his fingers. This causes the container 10 to move, such movement in turn imparting motion to the spherical weight 20. The subsequent motion of the spherical weight 20 causes the container 10 to move in a manner that is unanticipated based on the user's prior knowledge of the motion of objects having shapes similar to the subject of this invention. Specifically, the shape of the container 10 affords the spherical weight 20 two translational degrees of freedom—referring to FIG. 2, one in the "X" direction and one in the "Z" direction. The existence of two degrees of freedom causes the container upon prodding to exhibit the following types of motion, both singly, in combination, or in random sequence: pitching or tumbling in any direction; and rolling about the longitudinal axis.

Possession of two degrees of freedom by the spherical weight 20 gives the container 10 significantly more visual impact than prior art toys containing a spherical weight having but one degree of freedom, since unanticipated motion with such prior art toys is limited to longitudinal tumbling. However, combined and sequential motions of the variety exhibited by the present invention are only obtained when the largest diameter of the container 10 is about 1.8 to 1.9 times as large as the distance between the top and bottom surface of the container measured on the longitudinal axis. With a lesser ratio, the variety and combinations of motions decrease and hence are less unanticipated. But usage of a ratio as described results in psychologically unanticipated movement that maintains the interest of the user.

The user may also use the invention by holding it in the palm of his hand and then moving his hand. Continued moving of the hand while the container is still in motion due to prior excitations produces further interesting container motion.

Figure 3A:
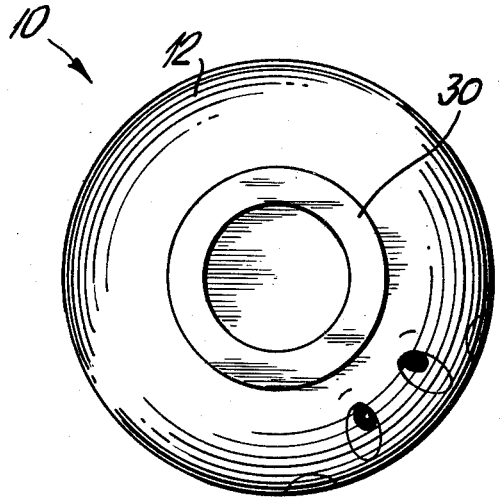
FIGS. 3A and 3B shows top and side views of an alternative embodiment equipped with thin annular discs to facilitate use.
Figure 3B:
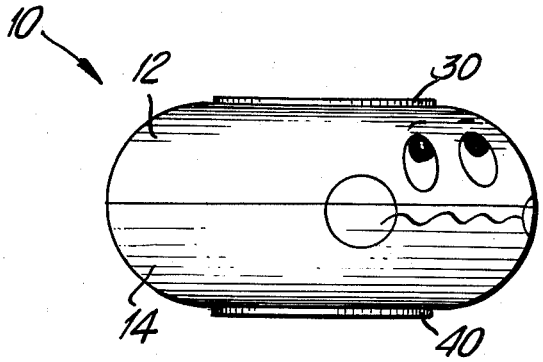

FIG. 3 shows another embodiment of the invention in which thin annular discs 30 and 40 are secured to opposite exterior surfaces of the container 10 in planes normal to the longitudinal axis and symmetrically positioned around the longitudinal axis. Glue may be used to secure the thin annular discs to the container.

The invention is primarily to be used by children. The alternative embodiment shown in FIG. 3 facilitates usage by a child, in that whichever thin annular disc 30 or 40 is exposed when the container 10 is at rest provides a surface for prodding an touching.

The container 10 can be made of any material. The wall thickness of the container is obviously limited by the ability of the spherical weight 20 to freely move. Generally, it is better to make the walls of the container 10 as thinly as structural integrity permits, since a thinner walled container will have less mass and hence possess less inertia. Consequently, container rolling and tumbling will be more rapid and will be sustained for longer periods of time.

The spherical weight 20 can be made of any material, as long as it has a greater mass than container 10. Generally, a metallic material is preferred for its significantly greater density and hence significantly greater mass and inertia as compared to container 10. Such characteristics prolong container rolling and tumbling. The spherical weight 20 is preferably solid throughout for the same reasons. The spherical weight 20 can be of any size, provided it has a diameter sufficiently smaller than the distance between the top and bottom surface of the container 10 measured along the longitudinal axis so that it can freely move about within the container 10. Generally, a larger spherical weight is preferable due to its greater mass and inertia. In a current examplary embodiment, container 10 is an oblate spheroid of thin plastic material, less than 0.016 inches thick having a major diameter of about 1.875 inches, a minor diameter of about 1.00 inch, and spherical weight 20 is a steel sphere solid throughout having a diameter of about 0.625 inches.

Figure 4:
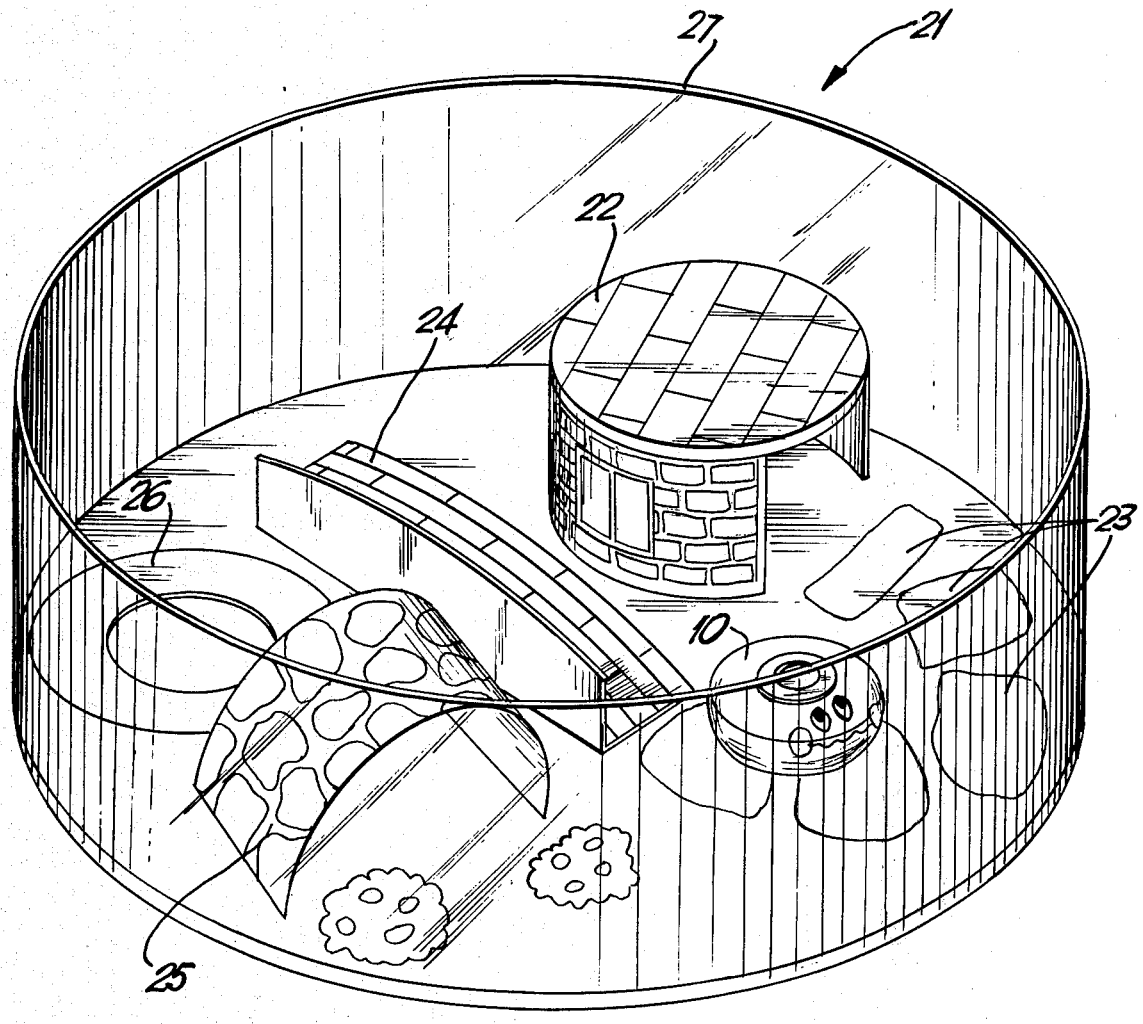
FIG. 4 shows an environment containing various fanciful features intended for interaction with the rolling toy of this invention.

FIG. 4 illustrates an exemplary environment 21 in which one or more rolling toys as previously described may be placed. The environment includes a fanciful house 22, a path 23, two bridges 24 and 25 and a pond 26. The environment 21 is bounded by transparent perimeter wall 27. By suitably tilting the environment, which in its current exemplary embodiment has a diameter of about 12 inches, a child, after sufficient practice, can cause the container 10 to leave the house 22, follow the path 23 across bridge 24, stop in pond 26, continue under bridge 25 and return to house 22.

None of this detailed description is intended to limit the scope of the following claims, which alone point out the subject matter regarded as the invention.

I claim:

1. A random motion tumbling toy, comprising:

(a) a hollow container (1) radially symmetrical about a longitudinal axis, the container having (2) a generally smooth curved surface which is sufficiently free of depressions, projections and sharp corners to allow the container to pitch or tumble in any plane; with (3) two thin annular discs secured to the exterior surface of opposite ends of the container in planes normal to the longitudinal axis and symmetrically positioned around the longitudinal axis; and (4) the container having a largest diameter which is about 1.8 to 1.9 times as large as the distance between the top and bottom surface of the container measured along the longitudinal axis; and (b) a spherical weight (1) located within the container, having (2) a diameter sufficiently smaller than the distance between the top and bottom surface of the container measured along the longitudinal axis so that the spherical weight can freely move about within the container; and having (3) a mass greater than the mass of the container.

2. The toy as described in claim 1, wherein the hollow container is in the shape of an oblate spheroid having a major diameter about 1.8 to 1.9 times as large as its minor diameter.

3. The toy recited in claim 1 or 2 wherein the spherical weight is solid and is made of a metal.

4. The toy recited in claim 1 or 2 wherein the container comprises two similarly shaped surfaces fastened together at their peripheries.

5. The toy recited in claim 3, wherein the container comprises two similarly shaped surfaces fastened together at their peripheries.

6. The toy recited in claim 1 or 2 having a representation of a face on the outer surface of the container.

7. The toy recited in claim 3, having a representation of a face on the outer surface of the container.

8. The toy recited in claim 4, having a representation of a face on the outer surface of the container.

9. The toy recited in claim 5, having a representation of a face on the outer surface of the container.

10. A random motion tumbling toy, comprising:

(a) a hollow container in the shape of an oblate spheroid having a major diameter of about 1.875 inches and a minor diameter of about 1.00 inch, the container being comprised of a plastic material less than 0.016 inch thick, the container having two thin annular discs secured to the exterior surface of opposite ends of the container in planes normal to the minor diameter and symetrically positioned around the minor diameter; and (b) a solid steel sphere about 0.625 inch in diameter located within and free to move about the container.

11. The toy of claim 10 in which the outer surface of the hollow container includes a representation of a face.

12. A random motion tumbling toy comprising:

(a) a thin-walled container enclosing (b) a spherical weight;

the container having a surface shape defined by the revolution of a curved line about an axis, the largest diameter of the surface of revolution of the container being 1.8 to 1.9 times the dimension of the container along the axis of revolution, the container further comprising two annular discs secured to opposite exterior surfaces of the container in planes normal to the axis of revolution and symmetrically positioned around the axis of revolution.

13. The toy as described in claim 12 wherein the curved line revolved about the axis of revolution is an ellipse.

* * * * *